US011812898B2

(12) United States Patent
Campbell

(10) Patent No.: US 11,812,898 B2
(45) Date of Patent: Nov. 14, 2023

(54) PORTABLE TOWEL DISPENSING DEVICE

(71) Applicant: Dwayne Campbell, Killeen, TX (US)

(72) Inventor: Dwayne Campbell, Killeen, TX (US)

( * ) Notice: Subject to any disclaimer, the term of this patent is extended or adjusted under 35 U.S.C. 154(b) by 31 days.

(21) Appl. No.: 17/671,763

(22) Filed: Feb. 15, 2022

(65) Prior Publication Data

US 2023/0255413 A1 Aug. 17, 2023

(51) Int. Cl.
*A47K 10/38* (2006.01)
*A47K 10/32* (2006.01)

(52) U.S. Cl.
CPC .. *A47K 10/3827* (2013.01); *A47K 2010/3206* (2013.01)

(58) Field of Classification Search
None
See application file for complete search history.

(56) References Cited

U.S. PATENT DOCUMENTS 790,003 A * 5/1905 Ritzenthaler ..... A01K 97/06 242/138
1,255,772 A * 2/1918 Miller ..... B65D 59/04 206/226
1,523,297 A * 1/1925 Savery ..... B65D 83/0805 206/226
1,582,645 A * 4/1926 Findley ..... A47K 5/1214 206/226
2,978,156 A * 4/1961 Yaniello ..... A47K 10/38 225/46
3,721,395 A 3/1973 Snipes
3,775,801 A * 12/1973 Walker ..... A47K 10/3827 15/104.93
4,192,561 A 3/1980 Gunn
4,576,279 A * 3/1986 Ferderber ..... A45C 11/24 206/226
D284,331 S * 6/1986 O'Toole ..... D3/315
4,936,452 A * 6/1990 Pauley ..... A47K 10/3827 225/84
D316,789 S 5/1991 McLaughlin
5,763,984 A 6/1998 Day
D419,015 S 1/2000 Umemoto
6,530,473 B1 * 3/2003 St. Felix ..... B60R 7/084 206/812
6,929,213 B1 8/2005 Contreras
7,395,950 B2 * 7/2008 Ropp ..... D05B 91/16 223/106
D576,433 S * 9/2008 Che ..... D30/153
(Continued)

FOREIGN PATENT DOCUMENTS

WO WO2013057565 4/2013

*Primary Examiner* — William A. Rivera

(57) ABSTRACT

A portable towel dispensing device for carrying the paper towel dispenser by an attachable strap includes a tube. The tube has an end and an opposite end. A solid end is coupled to the end and a cap end is positioned on the opposite end. The cap end can be removable from the tube to expose a hollow interior to the user. A roll of paper towels is contained within the hollow interior. A plurality of belt clips is coupled to an exterior of the tube. Each of the belt clips has an aperture. A strap has a pair of ends with a hook clip coupled to each of the ends. Each of the hook clips attaches to the aperture of each of the belt clips. The strap is positioned on the shoulder or the waist of the user.

14 Claims, 6 Drawing Sheets

(56) References Cited

U.S. PATENT DOCUMENTS

| | | | | |
|---|---|---|---|---|
| 8,517,171 | B1 * | 8/2013 | Delgado | B65D 21/0231 206/38.1 |
| D922,759 | S * | 6/2021 | Valletta | D3/201 |
| 2003/0213828 | A1 * | 11/2003 | McKenzie | A45F 3/14 224/677 |
| 2004/0004013 | A1 * | 1/2004 | Dleter | A47K 10/3827 206/409 |
| 2009/0289137 | A1 * | 11/2009 | Fischer | A47K 10/40 221/45 |
| 2017/0156457 | A1 * | 6/2017 | Wilcox | A47K 10/38 |

* cited by examiner

PORTABLE TOWEL DISPENSING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to paper towel dispensers and more particularly pertains to a new paper towel dispenser for carrying the paper towel dispenser by an attachable strap.

(2) Description of Related Art Including Information Disclosed Under 37 CFR 1.97 and 1.98

The prior art relates to paper towel dispensers. The prior art includes a variety of paper towel dispensers being a portable enclosed container. Furthermore, the prior art relates to a variety of dispensers for sheet products including paper towels and tissues. Know prior art lacks of a paper towel dispenser being a portable enclosed container comprising an attachable strap configured for being worn on the shoulder of the user or the waist of the user.

BRIEF SUMMARY OF THE INVENTION

An embodiment of the disclosure meets the needs presented above by generally comprising a tube. The tube has a hollow interior being configured for holding a roll of paper towels. A solid end is coupled to an end of the tube. The solid end encloses the hollow interior of the tube. A cap end is positioned on an opposite end of the tube. The cap end can be removable from the tube to expose the hollow interior of the tube. A plurality of belt clips is coupled to an exterior of the tube. Each of the belt chips has an aperture. The aperture is configured for providing a space for a hook clip to be positioned around. A strap has a pair of ends. Each hook clip of a pair of hook clips is coupled to a respective one of each of the ends of the strap. Each of the hook clips is configured for attaching to a respective one of the aperture of each of the belt clips. The strap is configured for being worn on either the shoulder of the user or the waist of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
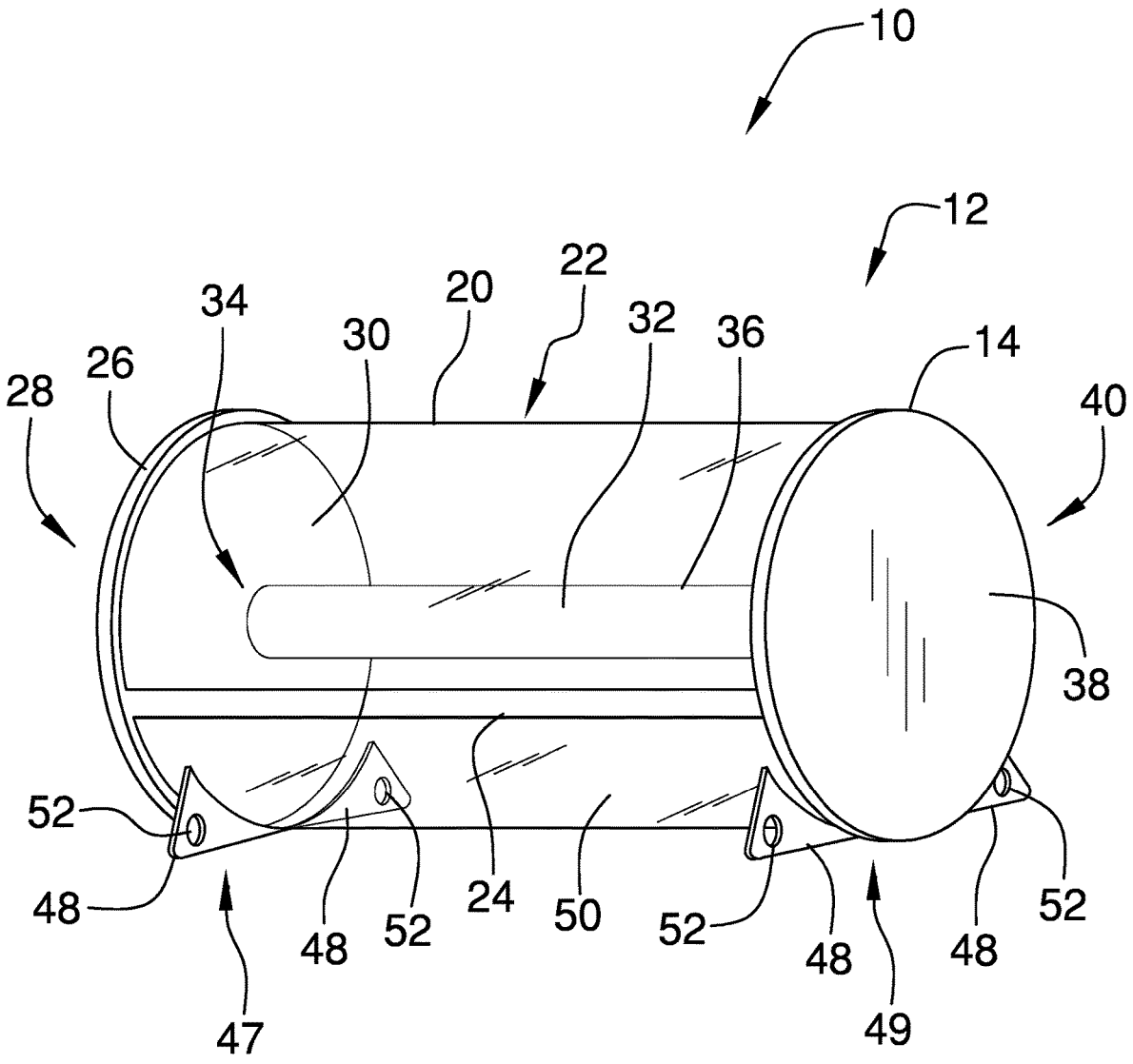
FIG. 1 is an isometric view of a portable towel dispensing device according to an embodiment of the disclosure.
Figure 2:
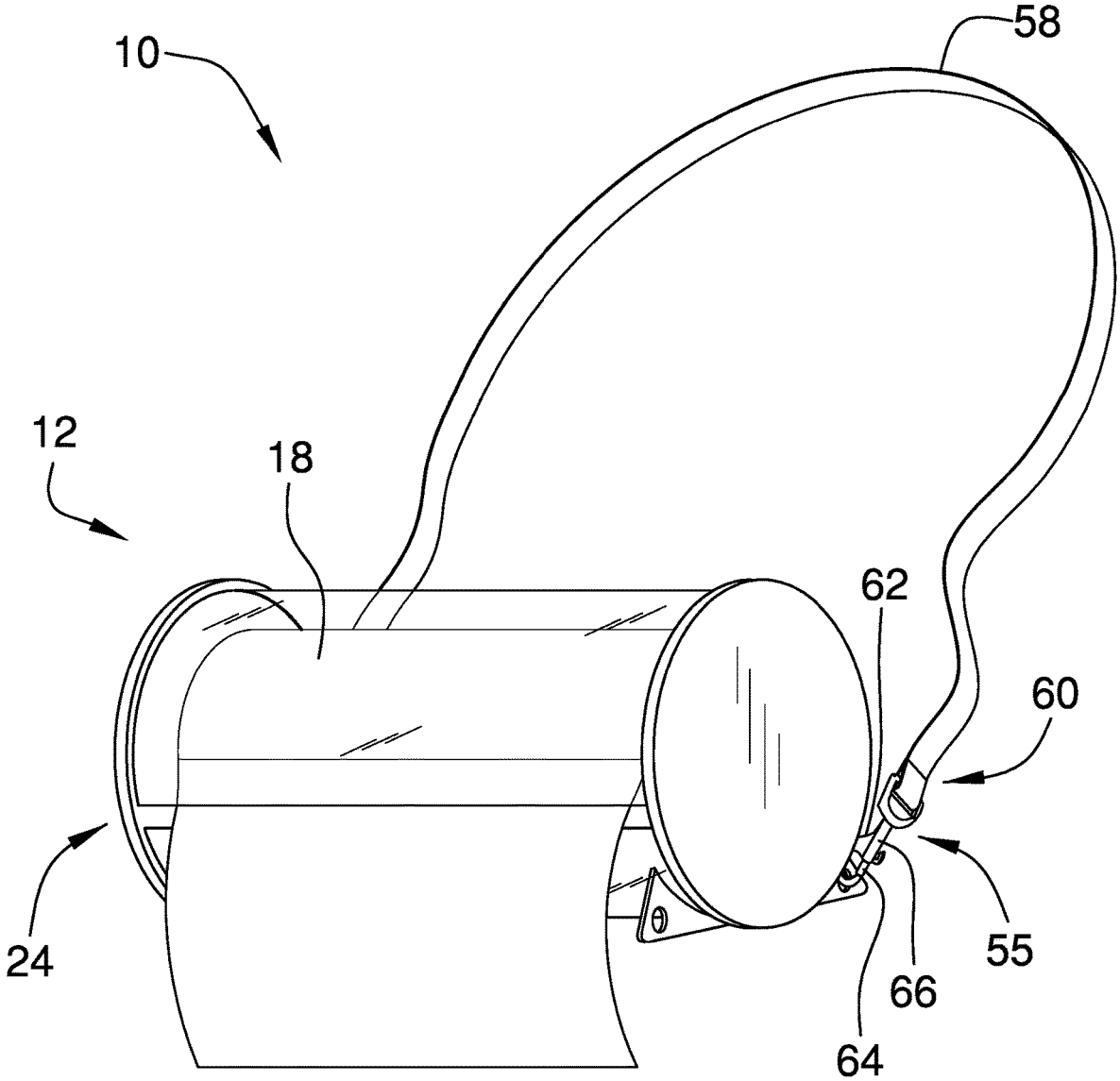
FIG. 2 is an isometric view of an embodiment of the disclosure.
Figure 3:
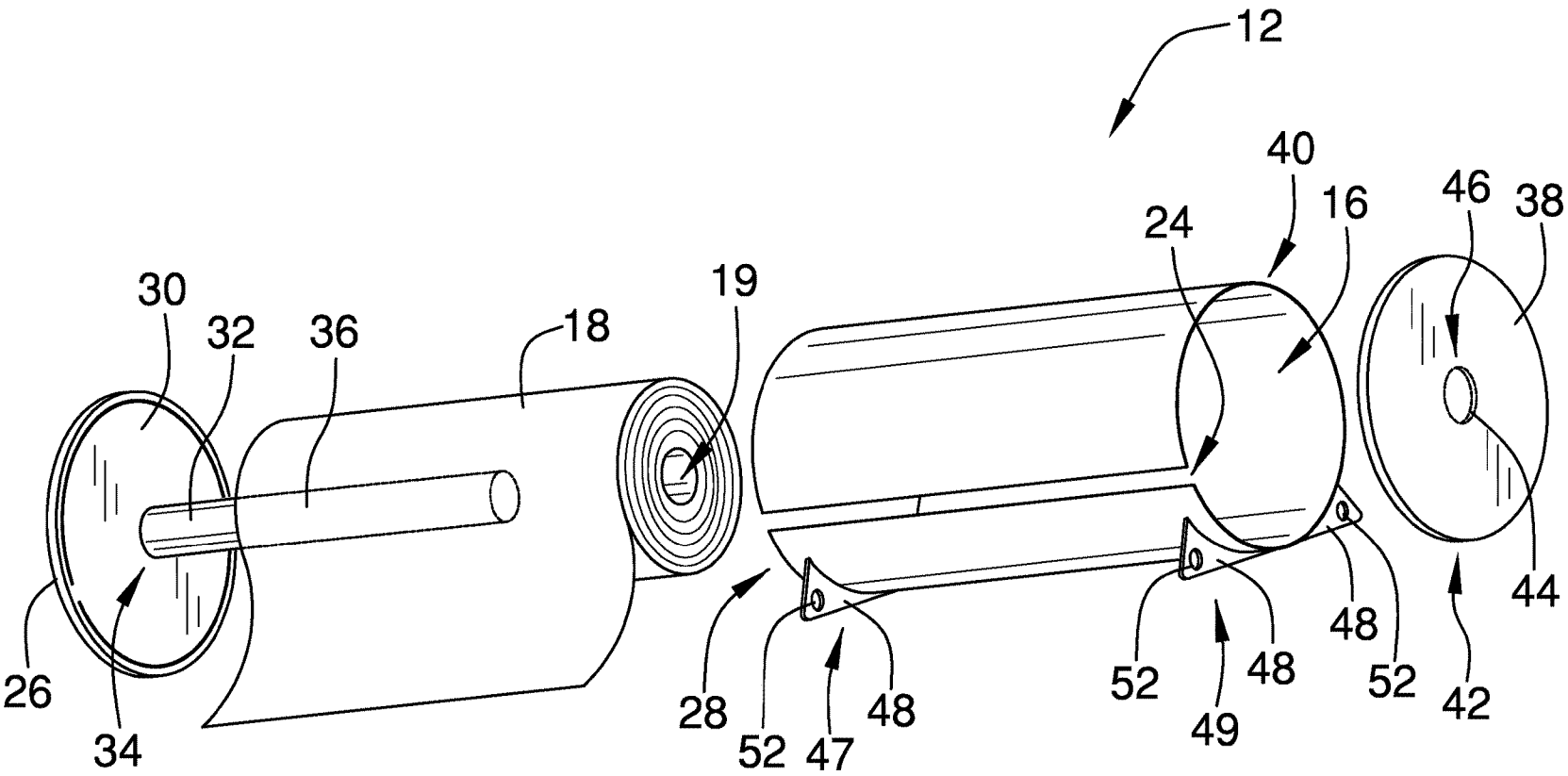
FIG. 3 is an assembly view of an embodiment of the disclosure.
Figure 4:
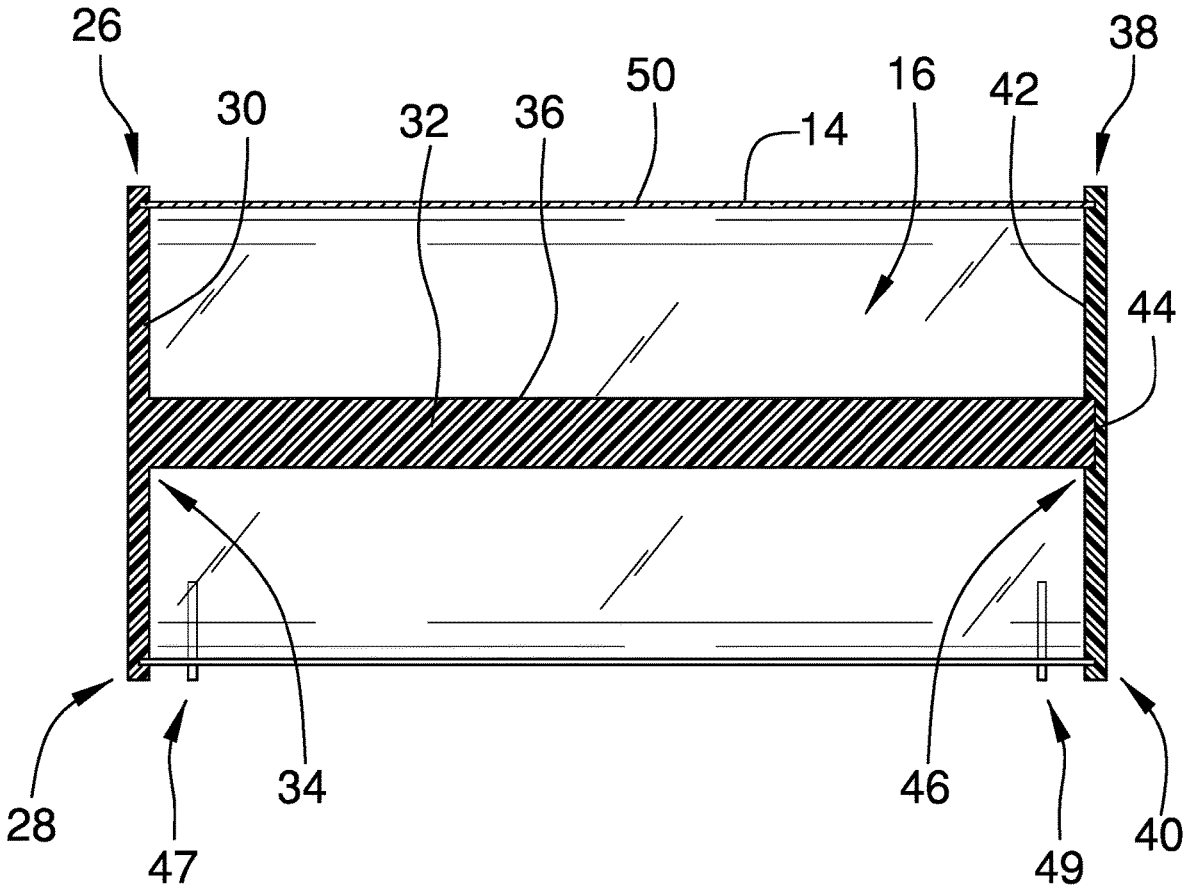
FIG. 4 is a section view of an embodiment of the disclosure.
Figure 5:
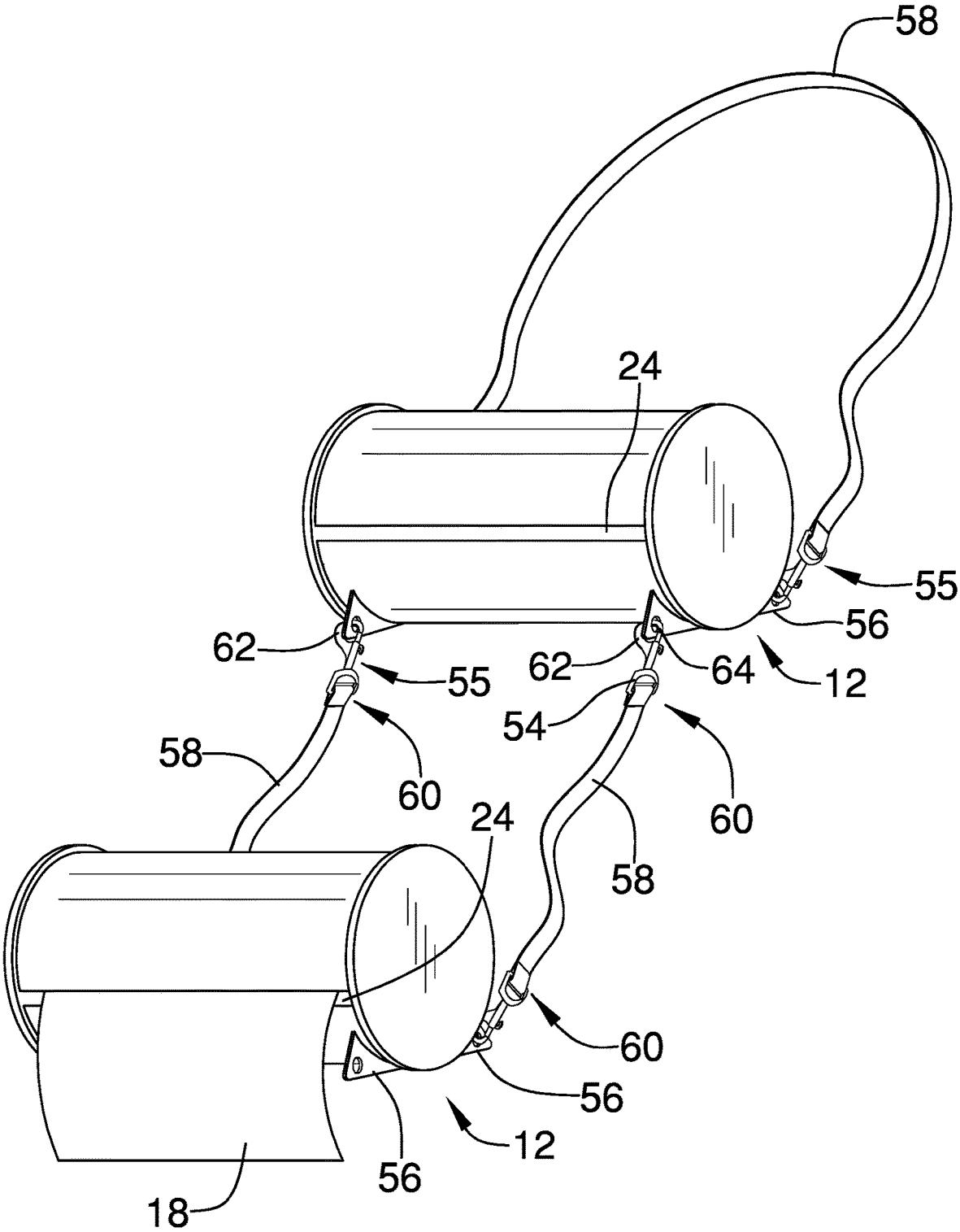
FIG. 5 is an isometric view with a second dispenser of an embodiment of the disclosure.

With reference now to the drawings, and in particular to FIGS. 1 through 6 thereof, a new paper towel dispenser embodying the principles and concepts of an embodiment of the disclosure and generally designated by the reference numeral 10 will be described.

As best illustrated in FIGS. 1 through 6, the portable towel dispensing device 10 generally comprises a tube 12. The tube 12 has a cylindrical shaped body 14 with a hollow interior 16. The hollow interior 16 defines a space where a roll of paper towels 18 is stored. The tube 12 is a plastic material 20 and is transparent 22. The tube 12 has a slot 24. The slot 24 defines a space where each towel 18 of the roll of paper towels 18 can be removed. The tube 12 is configured for dispensing each towel 18 of a roll of paper towels 18.

A solid end 26 is coupled to an end 28 of the tube 12. The solid end 26 is circular and concentric to the end 28 of the tube 12. The solid end 26 is positioned in a fixed positioned relative to the tube 12. The solid end 26 has an interior surface 30. A bar 32 is coupled to the interior surface 30 of the solid end 26.

The bar 32 is positioned in a center 34 of the interior surface 30 of the solid end 26 and protrudes out therefrom. The bar 32 has a cylindrical shaped body 36 and is in a fixed position relative to the solid end 26. The bar 32 is configured for enwrapping a roll of paper towels 18 around itself.

A cap end 38 is positioned on an opposite end 40 of the tube 12. The cap end 38 is a lid and can be removable. The cap end 38 is configured for exposing the hollow interior 16 to a user 11 whereby the user 11 can either insert or remove the roll of paper towels 18.

The cap end 38 has an interior surface 42. When the cap end 38 is positioned on the opposite end 40 of the tube 12, the cap end 38 is concentric to the solid end 26 and the interior surface 42 of the cap end 38 is facing towards the hollow interior 16 of the tube 12. A hole 44 is positioned in a center 46 of the interior surface 42 of the cap end 38. The hole 44 is configured for providing a space to hold a free end 46 of the bar 32 and retain the roll of paper towels 18 from lateral movement within the tube 12.

A plurality of belt clips 48 is coupled to an exterior surface 50 of the tube 12. A first pair of belt clips 47 of the plurality of belt clips 48 is positioned proximal to the solid end 26 and the second pair of belt clips 49 of the plurality of belt clips 48 is positioned proximal to the opposite end 40 of the tube 12. Each of the belt clips 48 is coplanar with each other and is configured for providing support to the tube 12 when the tube 12 is positioned on a surface.

Each of the belt clips 48 has an aperture 52. The aperture 52 is circular and is configured for providing a space where a hook clip 54 can be positioned around. Each of the belt clips 48 has a flat edge 56. The flat edge 56 of each of the belt clips 48 is configured for retaining the tube 12 from rotational movement when the tube 12 is positioned on a surface.

A strap 58 has a pair of ends 60. Each hook clip 55 of a pair of hook clips 55 is coupled to a respective one of each of the ends 60. Each of the hook clips 55 comprises a curved bar 62 and a retractable bar 64. The curved bar 62 is configured to give each of the hook clips 55 a circular shape. The retractable bar 64 is spring loaded to retract to a closed position when no outside influence is applied. Each of the hook clips 55 can be closed or open.

When closed, each the hook clips 55 embodies the circular shape. When open, the retractable bar 64 is pulled into an interior 66 of each of the hook clips 55 and allows for the curved bar 62 to be inserted into a closed-loop structure. Each of the hook clips 55 is configured for securing to a respective one of the aperture 52 of the first pair of belt clips 47 and to a respective one of the aperture 52 of the second pair of belt clips 49.

Figure 6:
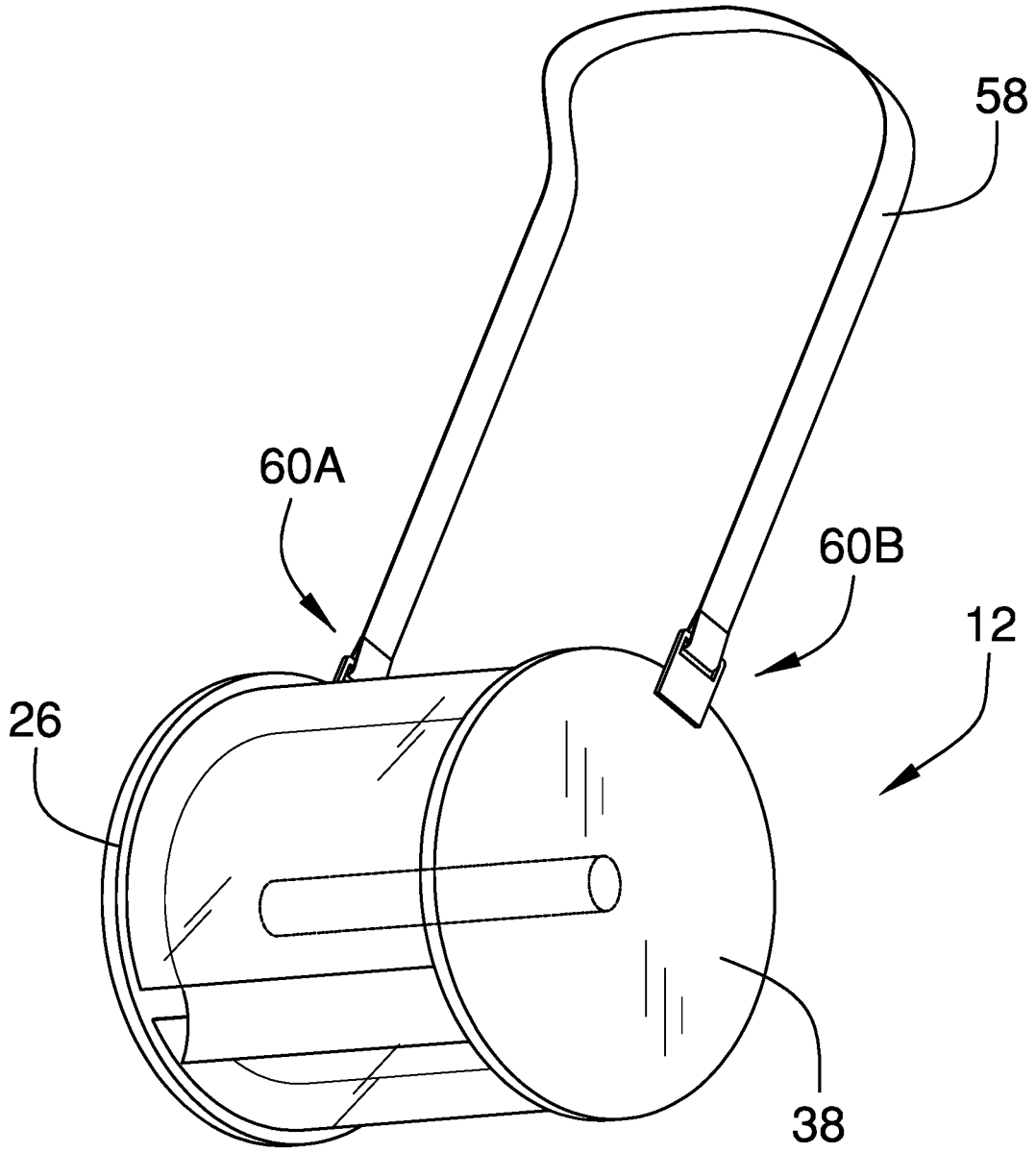
FIG. 6 is an alternate view of an embodiment of the disclosure.

Shown in FIG. 6 is an alternate embodiment of the portable towel dispensing device 10. This embodiment comprises the tube 12 and the strap 58. A first end 60A of the pair of ends 60 of the strap 58 is coupled to the solid end 26 of the tube 12 and a second end 60B of the pair of ends 60 of the strap 58 is coupled to the cap end 38 of the tube 12.

In use, each the hook clips 55 attaches to the aperture 52 of the first pair of belt clips 47 and to the aperture 52 of the second pair of belt clips 49. The strap is positioned either on the shoulder of the user 11 or the around the waist of the user 11. The user 11 removes the cap end 38 from the tube 12, and inserts a roll of paper towels 18 into the hollow interior 16 of the tube 12. An interior slot 19 of the roll of paper towels 18 defines a space for the bar 32 to be inserted within.

After the roll of paper towels 18 is positioned within the hollow interior 16 of the tube 12, the user 11 positions the cap end 38 on the opposite end 40 of the tube 12. Each towel 18 from the roll of paper towels 18 can be obtained from the slot 24 of the tube 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable towel dispensing device comprising:

a tube, said tube having a hollow interior, said hollow interior being configured for holding a roll of paper towels;

a solid end, said solid end being coupled to an end of said tube, said solid end enclosing said hollow interior of said tube;

a cap end, said cap end being positioned on an opposite end of said tube, said cap end can be removable from said tube;

a plurality of belt clips, each of said belt clips being coupled to an exterior of said tube, each of said belt clips have an aperture, said aperture being configured for providing a space for a hook clip to be positioned, said plurality of belt clips comprising two pairs of the belt clips the belt clips of each of the two pairs being coplanar, each belt clip having a flat surface the flat surfaces of the belt clips of each pair being linearly aligned tangential to the tube such that the belt clips are configured for inhibiting said tube from rotational movement when the flat surfaces are positioned on a surface; and a strap, said strap having a pair of ends, each hook clip of a pair of hook clips being coupled to a respective one of each of said ends of said strap, each of said hook clip being configured for attaching to a respective one of each of said apertures of each of said belt clips.

2. The portable towel dispensing device of claim 1, further comprising said tube having a cylindrical shaped body.

3. The portable towel dispensing device of claim 1, further comprising said tube being plastic, said tube being transparent.

4. The portable towel dispensing device of claim 1, further comprising said tube having a slot, said slot defining a spice for an outlet to each paper towel of said roll of paper towels.

5. The portable towel dispensing device of claim 1, farther said solid end being circular.

6. The portable towel dispensing device of claim 5, further comprising said solid end being in a fixed positioned relative to said tube.

7. The portable towel dispensing device of claim 1, further comprising said solid end having a center, said solid end having a bar protruding out from said center.

8. The portable towel dispensing device of claim 7, further comprising said bar being in a fixed position relative to said solid end, said bar being circular, said bar being configured for enwrapping a roll of paper towels around.

9. The portable towel dispensing device of claim 7, further comprising said cap end having a hole, said hole defining a space where an end of said bar can be positioned when said cap end being positioned on said tube.

10. The portable towel dispensing device of claim 1, further said cap end being a lid, said cap end being circular, said cap being concentric to said solid end.

11. The portable towel dispensing device of claim 1, further comprising said aperture being circular.

12. The portable towel dispensing device of claim 1, further comprising said strap being configured for being positioned on a shoulder of a user or a waist of the user.

13. The portable towel dispensing device of claim 1, further comprising said strap can be configured for attaching said portable towel dispensing device to another portable towel dispensing device.

14. A portable towel dispensing device comprising:

a tube, said tube having a cylindrical shaped body, said tube having a hollow interior, said hollow interior being configured for holding a roll of paper towels, said tube being plastic, said tube being transparent, said tube having a slot, said slot defining a space for an outlet to each paper towel of said roll of paper towels;

a solid end, said solid end being coupled to an end of said tube, said solid end being circular, said solid end enclosing said hollow interior of said tube, said solid end being in a fixed positioned relative to said tube, said solid end having a center, said solid end having a bar protruding out from said center, said bar being in a fixed position relative to said solid end, said bar being circular, said bar being configured for enwrapping a roll of paper towels around;

a cap end, said cap end being a lid, said cap end being circular, said cap end being positioned on an opposite end of said tube, said cap being concentric to said solid end, said cap end can be removable from said tube, said cap end having a hole, said hole defining a space where an end of said bar can be positioned when said cap end being positioned on said tube;

a plurality of belt clips, each of said belt clips being coupled to an exterior of said tube, said aperture being circular, said aperture being configured for providing a space for a hook clip to be positioned, said plurality of belt clips comprising two pairs of the belt clips, the belt clips of each of the two pairs being coplanar, each belt clip having a flat surface, the flat surfaces of the belt clips of each Pair being linearly aligned tangential to the tube such that the belt clips are configured for inhibiting said tube from rotational movement when the flat surfaces are positioned on a surface; and a strap, said strap having a pair of ends, each hook clip of a pair of hook clips being coupled to a respective one of each of said ends of said strap, each of said hook clip being configured for attaching to a respective one of said apertures of each of said belt clips, said strap being configured for being positioned on a shoulder of a user or a waist of the user, said strap can be configured for attaching said portable towel dispensing device to another portable towel dispensing device.

* * * * *